United States Patent [19]

Clites

[11] 4,058,668

[45] Nov. 15, 1977

[54] COLD CRUCIBLE

[75] Inventor: Philip G. Clites, Silverton, Oreg.

[73] Assignee: The United States of America as represented by the Secretary of the Interior, Washington, D.C.

[21] Appl. No.: 662,665

[22] Filed: Mar. 1, 1976

[51] Int. Cl.[2] ..... F27D 1/12

[52] U.S. Cl. ..... 13/32

[58] Field of Search ..... 13/26, 27, 32, 35; 266/280

[56] References Cited

U.S. PATENT DOCUMENTS

| | | | |
|---|---|---|---|
| 3,461,215 | 8/1969 | Reboux | 13/27 |
| 3,520,980 | 7/1970 | Sterling et al. | 13/27 |

*Primary Examiner*—R. N. Envall, Jr.

*Attorney, Agent, or Firm*—William S. Brown; Donald A. Gardiner

[57] ABSTRACT

The side wall of a right-cylindrical crucible is formed by pairs of concentric tubes, one the outer and one the inner. Open upper ends of the inner tubes are spaced below closed upper ends of outer tubes, and a cooling water circuit serially through the inner and outer tubes is established by manifolds.

5 Claims, 2 Drawing Figures

COLD CRUCIBLE

FIELD OF INVENTION

Electric Furnaces, Induction Furnaces, Pool Surrounded By Coil.

PRIOR ART

Sterling et al U.S. Pat. No. 3,531,574, Clites et al U.S. Pat. No. 3,775,091; and "A New Method for Obtaining Refractory Single Crystals and Fused Ceramic Materials", by Aleksandrov, Osiko, Prokhorov and Tatarintsev.

OBJECTS

This invention relates to cold crucibles wherein highly reactive metals such as titanium and zirconium are melted by induction heating. Reaction of the metal in the melt with the walls of the crucible is prevented by the formation of a cake, or skull, of slag between the melt and the cold crucible wall and the crucible bottom. Since the slag is formed of calcium fluoride, no reaction of the melt metal with it or the crucible walls takes place, and the melt metal is electrically insulated from the crucible side wall and bottom.

Heretofore, cold crucible walls have been formed of vertical tubes through which cooling water is circulated from and to manifolds at the opposite ends of the tubes. These entailed cumbersome piping systems for the water supply and return conduits. The objects of this invention are to provide an extremely simple structure requiring no manifold around the top of the crucible wall so that it may be used as over-the-lip ladle while still providing extensive surface contact between the cooling water and the metal of the side wall tubes.

More specifically, it is intended now to provide a cold crucible wherein a right-cylindrical side wall is formed by a circular row of concentric inner and outer tube pairs. The lower ends of the inner tubes are engaged in holes in a plate, and the lower ends of the outer tubes are engaged in holes in a ring which rests upon and is spaced above the plate. The upper ends of the outer tubes are closed so that cooling water entering the lower end of one of the tube pairs flows upwardly through that tube and thence downwardly through the other.

Still another object is to provide a header for cooling water, which header extends across and beneath the crucible so as to cool the crucible bottom wall. More specifically, it is now proposed that the plate which constitutes the bottom of the crucible shall also constitute the top of one of the cooling wall headers, i.e., that there be a common wall between the crucible and a cooling water header.

Still another object is that the larger tubes in each pair be substantially D-shape, with their flat sides facing inwardly so that they form a nearly smooth inner side for the crucible wall.

These and other objects will be apparent from the following specification and drawing, in which.

Figure 1:
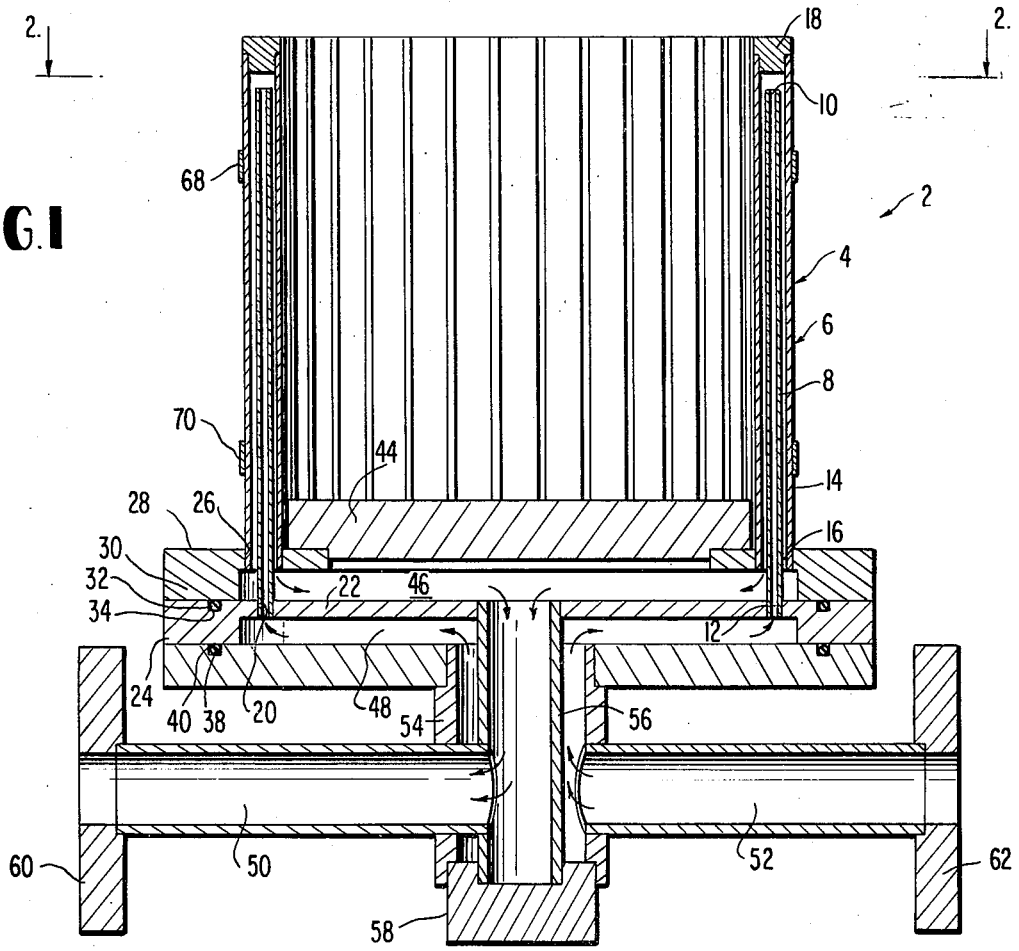
FIG. 1 shows the crucible in vertical cross section.
Figure 2:
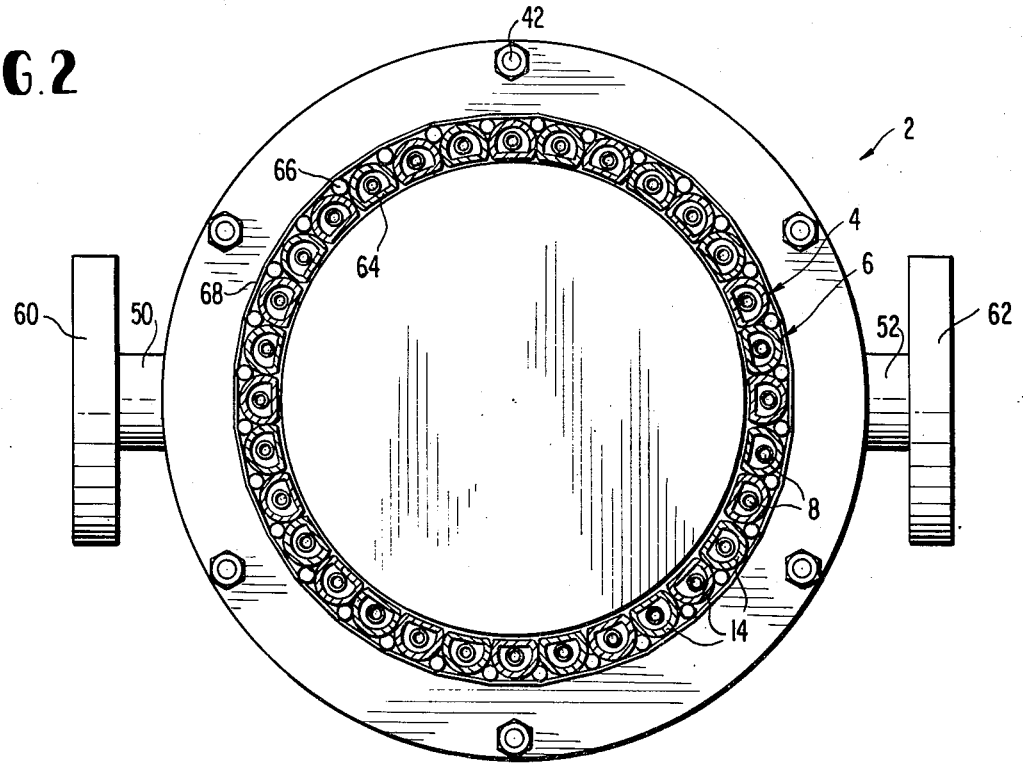
FIG. 2 is a transverse cross-section through the crucible looking downwardly in the direction of the arrows.

Referring now to the drawings in which like reference numerals denote similar elements, the cold crucible 2 is generally right-cylindrical in shape with a side wall 4 formed by a circular row of upstanding concentric tube pairs 6, each pair consisting of an inner tube 8 which is open at both its upper and lower ends 10 and 12 and an outer tube 14 which has an open lower end 16 and an upper end closed by a plug 18. The upper end 10 of the inner tube terminates below the plug 18 in the outer tube so that cooling water in one of the tubes can flow freely into the other tube.

The lower end portions of the inner tubes 8 sealingly engage in holes 20 in an intermediate plate 22 which has a depending flange 24. The lower end portions of outer tube 14 sealingly engage in holes 26 in a ring 28 which has a depending flange 30 which supports the ring above intermediate plate 22. An O-ring seal 32 in an annular groove 34 in the upper surface of intermediate plate 22 seals the ring 28 to intermediate plate 22 and the depending flange 24 of the intermediate plate is sealed against a base plate 36 by an O-ring 38 lying in an annular groove 40. Base plate 36, intermediate plate 22 and ring 28 are all held together by clamping bolts 42. A partition 44 forms the bottom of the crucible and the top wall of the one header space 46 whose periphery is defined by the depending flange 30 on ring 28, and this partition is sealed leak proof against the inner portion of ring 28. Another header space 48 lies between intermediate and base plates 22 and 36, respectively, and its periphery is defined by the depending flange 24 on the intermediate plate. Water feed pipes 50 and 52 are respectively connected to the header spaces 46 and 48 by concentric outer and inner pipes 54 and 56, both of which are sealed by a plug 58 at their lower ends. The feed pipes have conventional coupling flanges 60 and 62. The inner sides of the outer tubes are flattened as indicated at 64 so as to make the outer tubes substantially D-shape and thereby present a nearly smooth side to the crucible interior. Rods 66 of alumina are held by tapes 68 in the crevices between the outer sides of the larger tubes 14 so as to prevent molten calcium fluoride from leaking from the ladle during melting.

While dimensions form no part of the invention, an approximation of the size of the assembly may be gained by the fact that in one working embodiment, the diameter of the crucible is 5 inches, the outer tubes 14 were ½ inch OD and the inner tubes were ¼ inch OD. An induction coil, not shown, is supported around the outside of the crucible, and the material to be melted is placed on the inside.

The operation of crucibles of this general type is well known. Calcium fluoride is added to the ladle and a charge of, for example, titanium, and preferably of cylindrical shape is inserted. The calcium fluoride insulates the titanium from the ladle sides and bottom. The high-frequency induction coil, not shown, melts the charge which may then be poured out over the ladle lip.

I claim:

1. A cold crucible having a normally vertical side wall formed of a plurality of vertical concentric tube pairs disposed side-by-side, each tube pair being comprised of an outer tube having a closed upper end and an open lower end and an inner tube spaced inwardly from the outer tube and having open upper and lower ends, plural header means respectively connected to the lower ends of each of the tubes in the pairs, and means for connecting water supply and return conduits to the respective header means.

2. A cold crucible as defined in claim 1, said side wall being of closed configuration as seen in plan view, and having a bottom constituted by a partition which is common to the interior of the crucible and one of said header means.

3. A cold crucible as defined in claim 2, said crucible being of right-cylindrical form, said side wall being circular as seen in plan view.

4. A cold crucible as defined in claim 3, said outer tubes being substantially D-shape with substantially flat sides thereof facing radially inward.

5. A cold crucible as defined in claim 1, said side wall being circular as seen in plan view, said outer tubes being substantially D-shape with substantially flat sides thereof facing inwardly of the circle.

* * * * *